US006102512A

United States Patent [19]

Torii et al.

[11] Patent Number: 6,102,512

[45] **Date of Patent: *Aug. 15, 2000**

[54] METHOD OF MINIMIZING INK DROP VELOCITY VARIATIONS IN AN ON-DEMAND MULTI-NOZZLE INK JET HEAD

[75] Inventors: Takuji Torii; Nobuhiro Noto; Kazuaki Akimoto; Shigenori Suematsu; Yoshitaka Akiyama; Ryoji Yabuki, all of Ibaraki, Japan

[73] Assignee: Hitachi Koki Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/815,004

[22] Filed: Mar. 14, 1997

[30] Foreign Application Priority Data

Mar. 15, 1996 [JP] Japan ..... 8-058627
Jul. 26, 1996 [JP] Japan ..... 8-197317

[51] Int. Cl.[7] ..... B41J 29/38

[52] U.S. Cl. ..... 347/10

[58] Field of Search ..... 347/10–12, 68–72

[56] References Cited

U.S. PATENT DOCUMENTS

| | | | |
|---|---|---|---|
| 4,326,206 | 4/1982 | Raschke | 347/68 X |
| 4,418,355 | 11/1983 | DeYoung et al. . | |
| 4,646,106 | 2/1987 | Howkins | 347/9 |
| 5,202,659 | 4/1993 | DeBonte et al. | 347/11 |

FOREIGN PATENT DOCUMENTS

| | | |
|---|---|---|
| 58-119872 | 7/1983 | Japan . |
| 6-143573 | 5/1994 | Japan . |
| 2157623 | 10/1985 | United Kingdom . |

*Primary Examiner*—John Barlow
*Assistant Examiner*—C. Dickens
*Attorney, Agent, or Firm*—Pillsbury Madison & Sutro LLP

[57] ABSTRACT

A piezoelectric element is driven by a predetermined pulse width in the range of 60 to 100% of the Helmholtz resonance vibration period of an ink vibration system comprising an orifice, a pressurizing chamber, a restrictor, the piezoelectric element, and an elastic material.

3 Claims, 5 Drawing Sheets

METHOD OF MINIMIZING INK DROP VELOCITY VARIATIONS IN AN ON-DEMAND MULTI-NOZZLE INK JET HEAD

BACKGROUND OF THE INVENTION

1. Field of the Invention

The invention relates to a method of driving an on-demand multinozzle ink jet head which uses a piezoelectric element, and particularly to a method of driving an on-demand multinozzle ink jet head in which a large number of nozzles are integrated at high density.

2. Description of the Related Art

In some on-demand ink jet heads, an ink pressurizing chamber is configured by opposing a plate in which a plurality of orifices are formed to a diaphragm which is to be elastically deformed by a piezoelectric element, and ink is subjected to suction and pressurization by expansion and contraction of the piezoelectric element, thereby ejecting an ink drop through a nozzle. In such an on-demand ink jet head, it is necessary to satisfactorily couple the piezoelectric element to the diaphragm, so that the displacement of the piezoelectric element is efficiently transmitted to the pressurizing chamber.

For example, Japanese Patent Unexamined Publication No. Sho 58-119872 proposes a technique in which a coupling member is inserted between a diaphragm and a piezoelectric element. Japanese Patent Unexamined Publication No. Hei 6-143573 proposes a technique in which an island portion is formed in a diaphragm at a position where a piezoelectric element is in contact with the diaphragm. Both the techniques are intended to efficiently transmit the driving force of the piezoelectric element to the diaphragm, and used for reducing variations among nozzles during a production process.

A conventional nozzle driving method will be described with reference to an exemplary case in which nozzles are driven by using a rectangular wave shown in FIG. 7.

FIG. 8 shows an example of an ink drop velocity obtained in experiments conducted by the inventors in which one prior art nozzle produced in accordance with appropriate specifications was used and the pulse width was changed while maintaining the voltage at a constant level. In the case of this nozzle, the ink drop velocity exhibits the maximum (peak) in the vicinity of 4.5 $\mu$s. The peak corresponds to a resonance point of the Helmholtz resonance vibration of the nozzle which is determined depending on the sizes, the materials, the physical properties, and the like of the ink passage system, the diaphragm, the piezoelectric element, etc. If the nozzle is driven by the pulse width at the peak position (4.5 $\mu$s), a high ink drop velocity can be obtained at a low voltage. Accordingly, such a prior art nozzle driving method has an advantage in that a desired ink drop velocity can be obtained by reduced power consumption.

The driving in the invention is performed in accordance with the following manner.

A condition in which the meniscus of a nozzle is neutral is regarded as an initial condition. A driving waveform is applied to a piezoelectric element. The meniscus is moved backward from an orifice (the direction from the orifice toward a printing sheet is defined to be forward, and the opposite direction is defined to be backward), so that ink is sucked from an ink tank via a restrictor. Thereafter, a pressure is applied to the ink-by a diaphragm so as to eject the ink to the outside from the orifice. In the case of a pulse of a rectangular wave, at the last timing of one pulse, an operation in which the diaphragm presses the ink and a pressure is applied thereto is performed. If the phase in which the meniscus is moved forward is established at this timing, the ink velocity is the maximum.

In view of this point, in the driving in the invention, it is presumed that a pulse width at which the drop velocity is the peak in FIG. 8 is a half of the period of the Helmholtz resonance vibration. In other words, the period of the Helmholtz resonance vibration is obtained as a doubled value (9 $\mu$s) of the pulse width (4.5 $\mu$s) at the peak in FIG. 8. When a nozzle is appropriately modeled as a vibration system, the Helmholtz resonance vibration period can be obtained by calculation.

For the purpose of increasing the printing speed, a multinozzle ink jet head in which a plurality of nozzles are integrated is the most suitable. In such a multinozzle ink jet head, however, variations may be caused in nozzle characteristics because of various reasons.

In the production of a conventional multinozzle ink jet head, for example, several thin plates or a dozen of thin plates of orifices and the like which are configured by an etched thin plate of stainless steel having a thickness in the range of several micrometers to several hundreds of micrometers or thin nickel plates formed by electroforming are often used as a member constituting a pressurizing chamber. Nozzles are formed by adhesion or metal bonding of these thin plates. In the case of adhesion, an adhesive agent between the plates must be cured, and, in the case of metal bonding, a metal which serves as a coupling member between the plates must be melted. Therefore, a heating process is required in both the cases. If different kinds of metals are combined by heating, there occurs residual heat distortion caused by a difference between coefficients of thermal expansion of the members. This causes the head to slightly warp.

In such nozzles, the pulse width at the resonance point is slightly varied from nozzle to nozzle. Even if nozzles have substantially the same resonance point, a difference is produced in peak values. On the other hand, in such a multinozzle head, when all nozzles are driven by a pulse width at the above-mentioned peak value or in the vicinity thereof and a constant voltage, the driving voltage can be lowered, but the drop velocity may be largely varied from nozzle to nozzle. This produces a large obstruction for higher printing quality.

SUMMARY OF THE INVENTION

The invention has been made to solve the above problem with the conventional method, and therefore an object of the invention is to provide a method of driving an on-demand multinozzle ink jet head having a plurality of nozzles in which variations in a driving voltage of nozzles can be reduced and excellent frequency characteristics are attained.

According to the invention, the above object has been achieved by the provision of a method of driving an on-demand multinozzle ink jet head having a plurality of nozzles, each of the nozzles including a pressurizing chamber which is communicated with an ink tank and which increases a pressure of ink; a piezoelectric element which causes pressure fluctuation in the pressurizing chamber by applying an electric signal; a diaphragm which forms at least a part of a wall face of the pressurizing chamber, and which is coupled to the piezoelectric element by means of an elastic material; a restrictor which serves as a passage for supplying ink to the pressurizing chamber; and an orifice through which ink drops are ejected from the pressurizing chamber, wherein the piezoelectric element is driven by a predetermined pulse width in a range of 60 to 100% of a Helmholtz resonance vibration period of an ink vibration system comprising the orifice, the pressurizing chamber, the restrictor, the piezoelectric element, and the elastic material. As a result, variations in driving voltage of the nozzles at the same velocity can be reduced, and excellent frequency characteristics can be obtained.

The above and other objects and features of the present invention will be more apparent from the following description taken in conjunction with the accompanying drawings.

DETAILED DESCRIPTION OF THE PREFERRED EMBODIMENTS

Hereinafter, the invention will be described with reference to the accompanying drawings.

Figure 1:
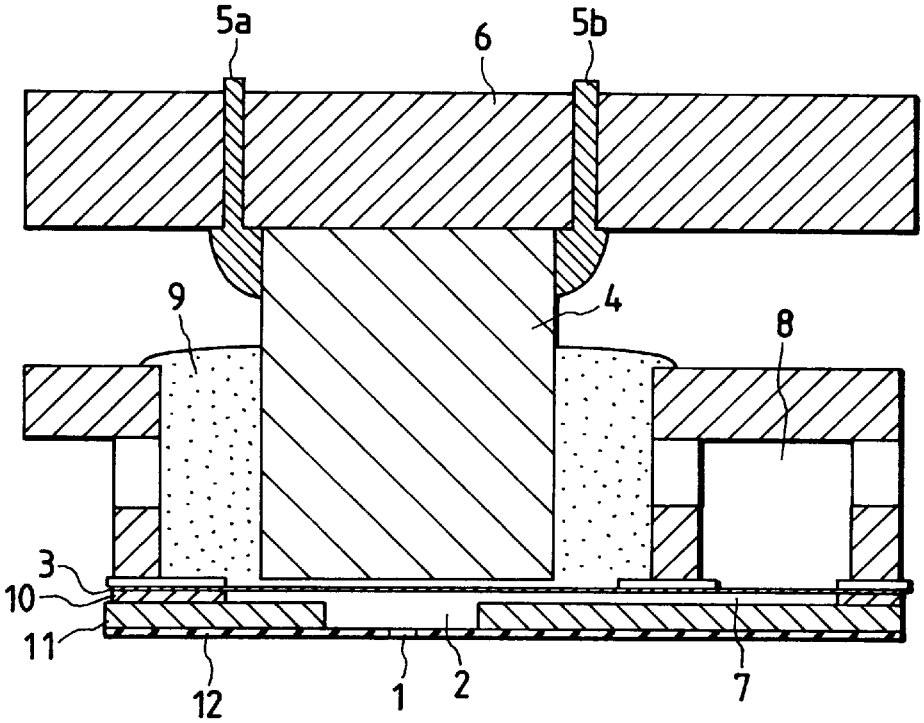
FIG. 1 is a section view of a nozzle of an ink jet head used in the invention.

FIG. 1 is a section view showing the structure of a nozzle portion of a multinozzle ink jet head used in the invention.

The head can perform printing by ejecting ink in accordance with an input signal. The reference numeral 1 designates an orifice, 2 designates a pressurizing chamber, 3 designates a diaphragm, 4 designates a piezoelectric element, 5*a* and 5*b* designate signal input terminals, 6 designates a head substrate, 7 designates a restrictor which couples an ink passage 8 to the pressurizing chamber 2 and controls the flow of ink to the pressurizing chamber 2, 8 designates the ink passage, 9 designates an elastic material (in the embodiment, silicone rubber) which couples the diaphragm 3 to the piezoelectric element 4, 10 designates a restrictor plate which forms the restrictor 7, 11 designates a chamber plate which forms the pressurizing chamber 2, and 12 designates an orifice plate which forms the orifice 1.

The diaphragm 3, the restrictor plate 10, and the chamber plate 11 are made of, for example, a stainless steel material. The orifice plate 12 is made of a nickel material. The head substrate 6 is made of an insulator such as ceramics.

Ink flows in the sequence of the ink passage 8, the restrictor 7, the pressurizing chamber 2, and the orifice 1.

The piezoelectric element 4 is mounted in such a manner that it is expanded when a positive potential is applied to the signal input terminal 5*a*, and it is not deformed when a potential difference between the signal input terminals 5*a* and 5*b* is eliminated.

Figure 2:
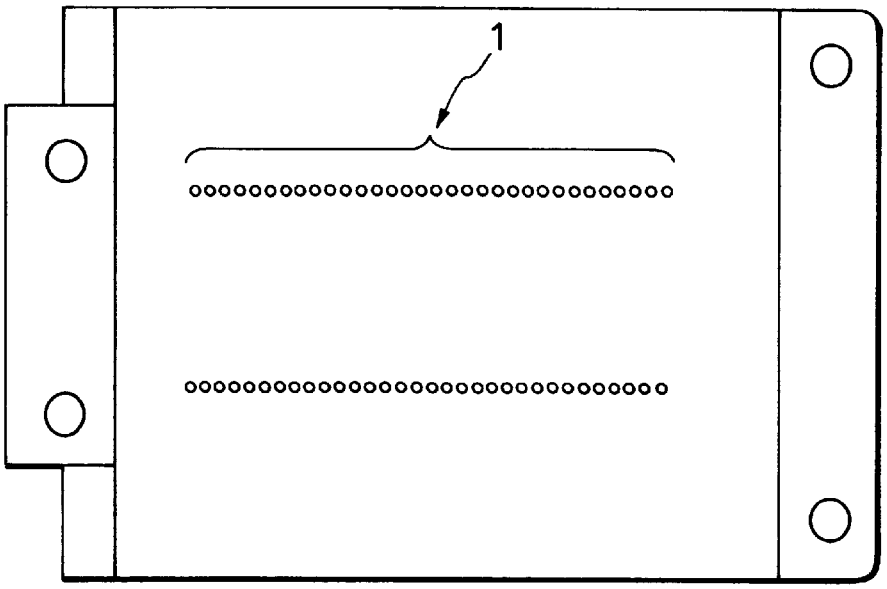
FIG. 2 is a front view of a multinozzle head used in the invention.

FIG. 2 is a front view of an ink jet head in which two rows of nozzles described in FIG. 1 are arranged and each row consists of 32 nozzles.

Figure 3:
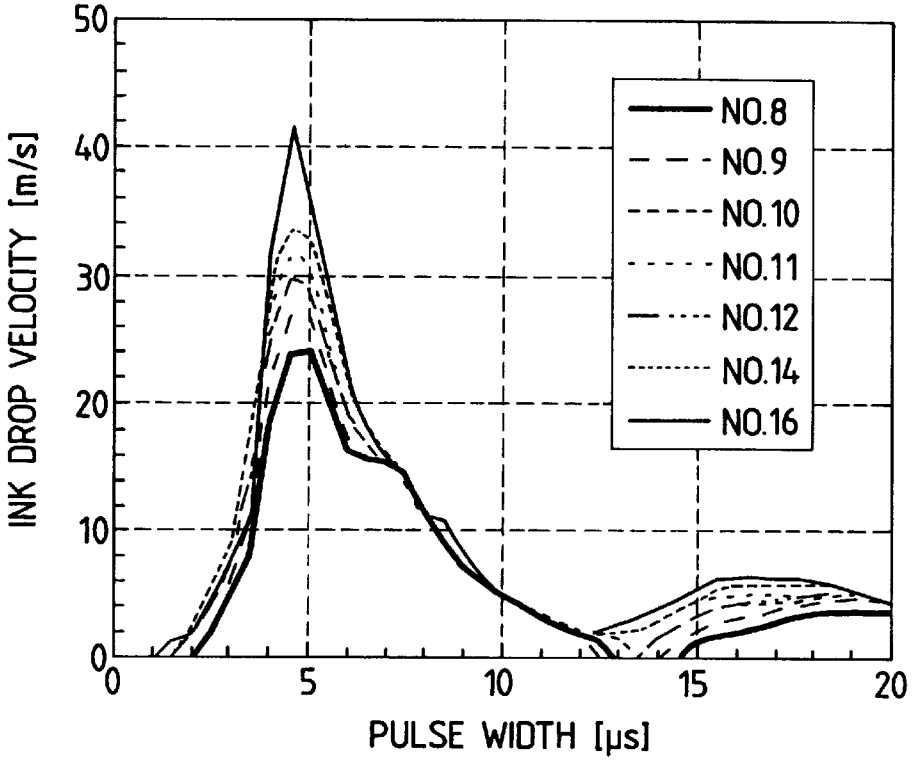
FIG. 3 is a graph showing relationships between the pulse width and the drop velocity.
Figure 7:
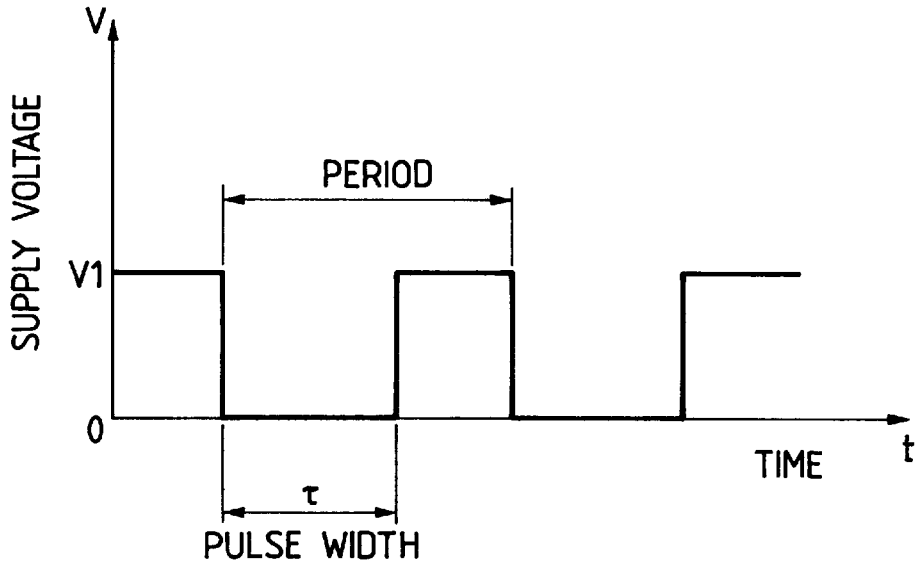
FIG. 7 is a diagram showing a rectangular wave which is used as the driving waveform.
Figure 8:
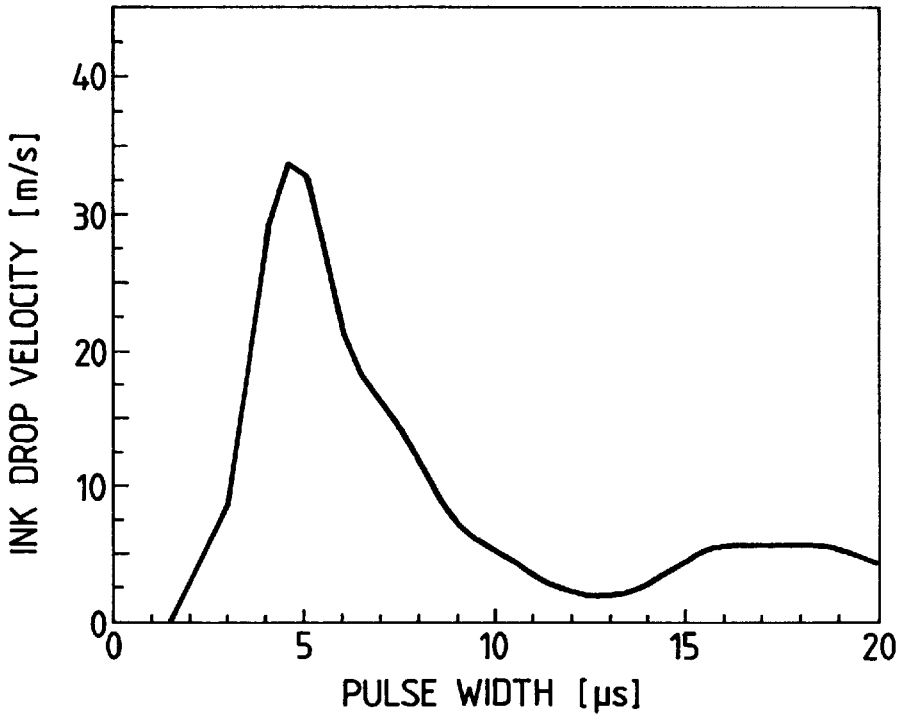
FIG. 8 is a graph showing relationships between the pulse width and the ink drop velocity.

FIG. 3 shows results of measurements of a relationship between a pulse width and an ink drop velocity in the case where seven nozzles are selected from among nine nozzles of No. 8 to No. 16 in the first row of the head shown in FIG. 2, and a rectangular wave shown in FIG. 7 is used as a driving waveform. The driving voltage is fixed at 30 V. The driving frequency is selected so as to be 2 kHz which is not affected by the repetition of ink ejection. In each of the nozzles in the figure, the phenomenon in which the velocity is the maximum at a specific pulse width occurs by the Helmholtz resonance vibration of the nozzle. Accordingly, it will be seen that the peak height and the pulse width of the peak are varied from nozzle to nozzle. When each of the nozzles thus has an inherent peak, the Helmholtz resonance vibration period is specified by the mean value of the Helmholtz resonance vibration periods of all the nozzles.

Conventionally, in order to reduce the power consumption, an electric signal for driving a head has a pulse width which can realize a high ink ejection efficiency. In the case of the figure, the driving pulse width is selected so as to be about 4.5 to 5 $\mu$s (from this, it will be seen that the Helmholtz resonance vibration periods of these nozzles are in the range of about 9 to 10 $\mu$s).

Figure 4:
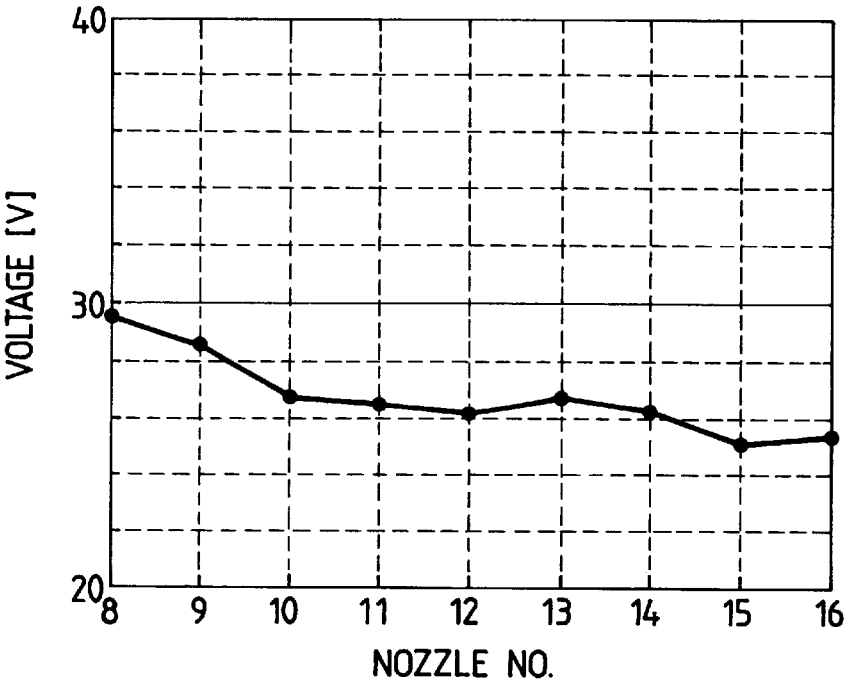
FIG. 4 is a graph showing variations in the driving voltage in the case where the pulse width and the ink drop velocity are fixed.

FIG. 4 shows results of measurements wherein a voltage at which the drop head velocity of 13 m/s is attained for each nozzle was measured for the same nozzle row as that used in FIG. 3 in the case where the driving pulse width is selected so as to be 6 $\mu$s at which a relatively high ejection efficiency is obtained. The driving voltage is in the range of 25.2 V to 29.5 V. From this figure, it is expected that the drop velocity is greatly varied when the driving is performed at a fixed voltage.

In order to improve this point, FIG. 3 is intensively reviewed. It is expected that, if a value larger than 6 $\mu$s is selected as the driving pulse width, the variation in driving velocity is reduced (although it is necessary to raise the driving voltage).

Figure 5:
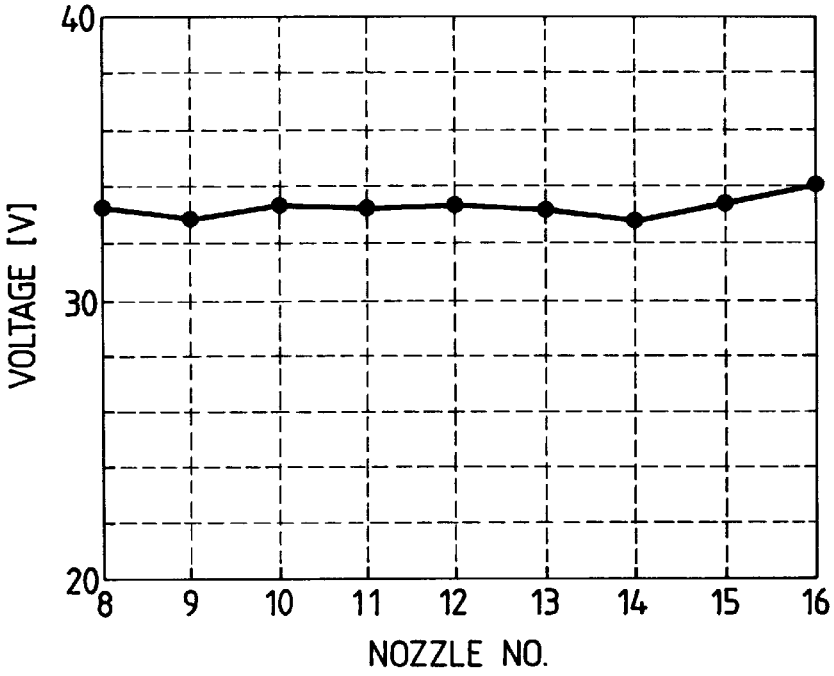
FIG. 5 is a graph showing variations in the driving voltage in the case where the pulse width and the ink drop velocity are fixed.

FIG. 5 shows results of measurements wherein a voltage at which an identical ink drop velocity (13 m/s) is attained in the case of the pulse width of 8 $\mu$s was measured. The value itself of the driving voltage is higher as compared with the case of FIG. 4, but the voltage difference among nozzles is 1.3 V at the maximum. Therefore, it will be clearly understood that the voltage variation is greatly reduced.

As described above, if the driving pulse width is larger than a half of the Helmholtz resonance vibration period, the velocity variation at the same voltage is reduced. However, as seen from FIG. 3, if the pulse width is made larger, the driving voltage becomes excessively higher for a practical use. In addition, the increase of the pulse width is not preferable in the view point of the high-frequency driving which is essential for high-speed printing. For this reason, it is desirable to set the pulse width so as to be as small as possible. This is the serious problem when the driving pulse width is to be selected.

For the above-discussed problem, i.e., the selection of the pulse width, results of another experiment will be useful.

Figure 6:
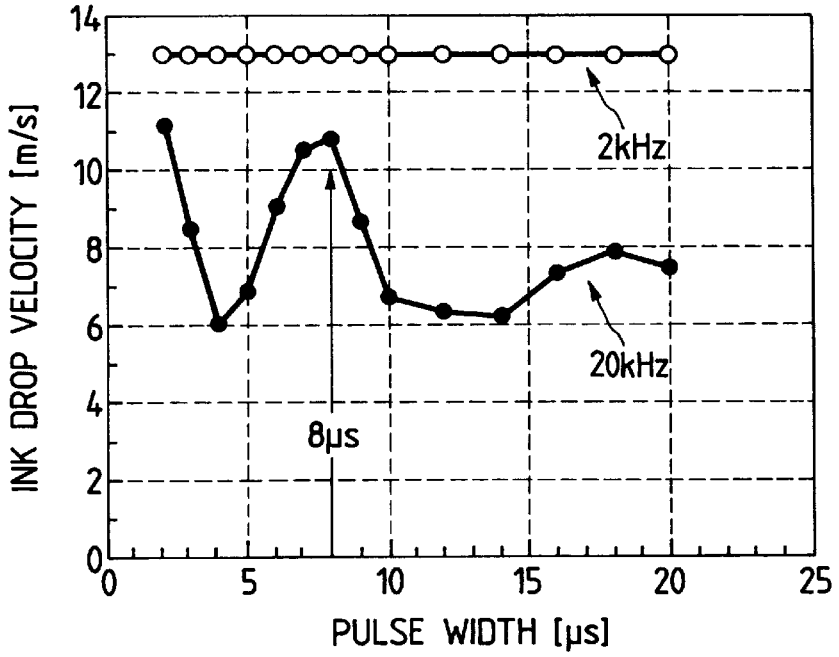
FIG. 6 is a graph showing relationships between the pulse width and the ink drop velocity.

FIG. 6 shows results of measurements wherein the drop velocity was measured with changing the frequency from 2 kHz to 20 kHz, for nozzles which are produced by the same specifications as those of the nozzle row used in the experiment of FIG. 4. In this case, for respective pulse widths, the driving voltage is selected so that the velocity is 13 m/s at the frequency of 2 kHz. Then, the drop velocity is measured when the driving is performed at the frequency of 20 kHz and at the selected voltage. As seen from FIG. 6, when the frequency is changed, the variation in drop velocity is decreased (a value in the vicinity of 13 m/s) at a specific pulse width (about 8 μs in this case).

On the other hand, in an ink jet printer, in the view point of the printing quality, a constant drop velocity is desired even if the driving frequency is changed. Specifically, if the drop velocity is different between the case where a continuous line is printed at a high frequency and that where a dotted line is printed at a lower frequency, a difference is produced in the time period which elapses before ink reaches the sheet, thereby increasing the possibility that printing positions are displaced on the sheet.

In view of the above and the frequency characteristics, it will be seen that a pulse width of about 8 μs is desirably selected. More strictly speaking, if the printing quality is not extremely degraded by lowering the velocity from 13 m/s at 2 kHz to 9 m/s at 20 kHz, it is sufficient that the pulse width is selected so as to be in the range of 6.2 to 8.9 μs.

When the above experimental results are summarized, it will be found that a pulse width of about 8 μs is more suitable for the nozzle row than that in the vicinity of a half of the Helmholtz resonance vibration period which is greater than 8 μs and which is conventionally regarded suitable as the driving pulse width.

The pulse width of 8 μs is near the period of the Helmholtz resonance vibration (9 to 10 microseconds) of the nozzle row. As a result, if a value in the vicinity of the period of the Helmholtz resonance vibration is selected as the driving pulse width, the driving voltage is slightly high but the variation among nozzles is decreased and the driving with excellent frequency characteristics can be realized. Thus, it is possible to provide a head for an ink jet printer with a superior printing quality.

When the above is quantitatively expressed, the pulse width is in the range of 6.2 to 8.9 μs and the natural vibration frequency is 9 to 10 μs. In general expression, if the pulse width is selected so as to be 60% (=6.2/10) to 100% (=8.9/9) of the natural vibration frequency, it is possible to set driving conditions with excellent frequency characteristics and reduced variation in driving voltage.

Figure 9A:
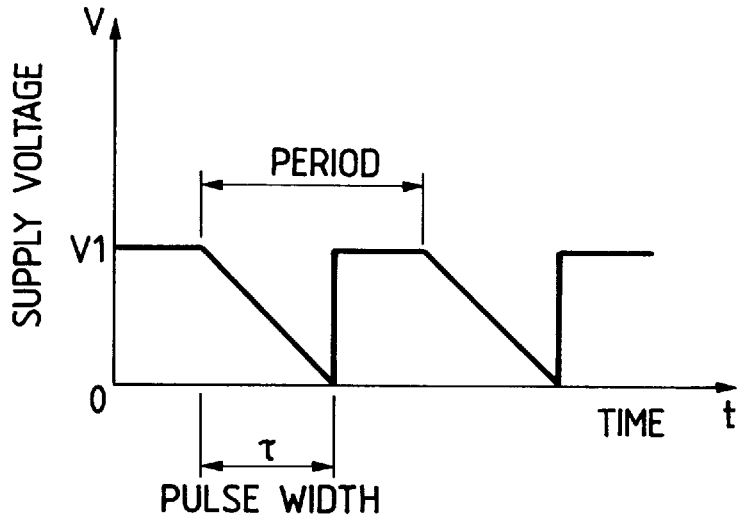
FIGS. 9A, 9B and 9C are diagrams showing examples of a driving waveform which can be used in the invention.
Figure 9B:
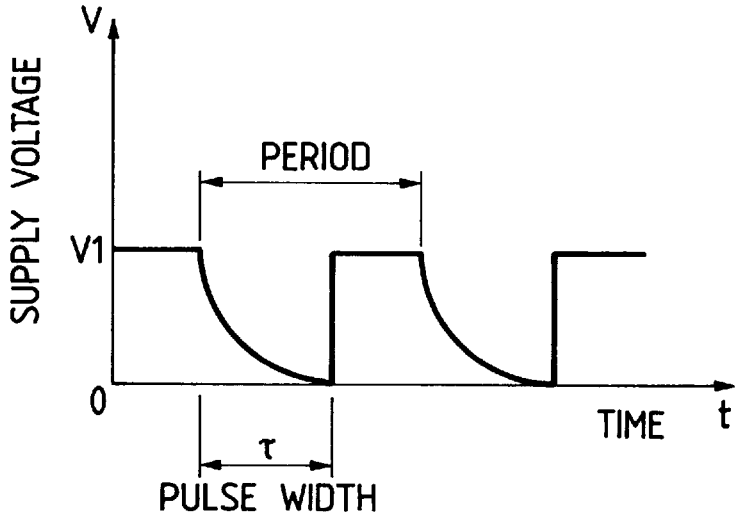
Figure 9C:
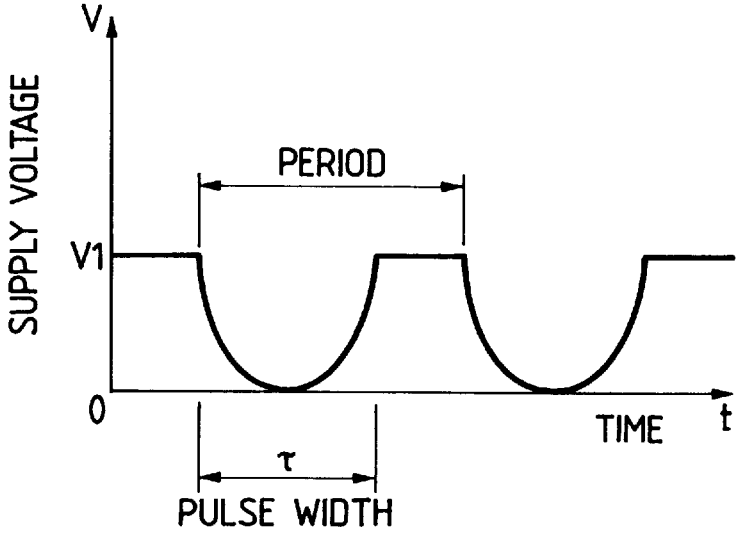

In the above description of the invention, a rectangular wave is used as the driving waveform. Alternatively, a triangular wave, an exponential wave, a sinusoidal wave, or the like as shown in FIGS. 9A, 9B and 9C may be used. Also in such an alternative, the same effects can be attained.

According to the invention, in multinozzle ink jet heads, variations in nozzle characteristics caused by variations due to the production process can be reduced. In addition, it is unnecessary to respectively control nozzles, and hence the cost of the power supply for driving the nozzles can be reduced. Furthermore, in the invention, it is not required to strictly control the thickness of an elastic material for coupling a piezoelectric element to a diaphragm. Accordingly, the invention can be applied to a multinozzle ink jet head which is to be produced by an industrially easy adhesion or joining method. Thus, the production cost of a head can be reduced.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A method of driving an on-demand multi-nozzle ink jet head having a plurality of nozzle portions, each of the nozzle portions having (i) an ink tank for supplying ink, (ii) a pressurizing chamber for pressurizing the ink supplied by the tank, (iii) a piezoelectric element for fluctuating pressure in the pressurizing chamber, the piezoelectric element being responsive to an electric signal for energizing the piezoelectric element, (iv) a diaphragm forming at least a part of a wall face of the pressurizing chamber, the diaphragm coupled to the piezoelectric element by an elastic material, and (v) an orifice through which ink drops are ejected from the pressurizing chamber, the method comprising:

(a) determining a Helmholtz resonance vibration period associated with each nozzle portion;

(b) energizing each piezoelectric element with an electric signal, the electric signal having a drive pulse of a predetermined width in a range of 60 to 100% of the Helmholtz resonance vibration period associated with the nozzle portion, the drive pulse reducing ink drop velocity variations in the nozzle portions caused by variations in nozzle characteristics;

(c) pressurizing each chamber with the energized piezoelectric element associated therewith; and (d) ejecting the ink drops from each of the plurality of pressurizing chambers through the orifice associated with each pressurizing chamber.

2. The method according to claim 1, wherein the variations in nozzle characteristics are caused by the production process.

3. The on-demand multi-nozzle ink jet head according to claim 7, wherein the drive pulse comprises one of a rectangular wave, a triangular wave, an exponential wave and a sinusoidal wave.

* * * * *